US008286944B2

(12) United States Patent
Rossato et al.

(10) Patent No.: US 8,286,944 B2
(45) Date of Patent: Oct. 16, 2012

(54) VEHICLE LIFT

(75) Inventors: Eride Rossato, Ballo' di Mirano (IT); Alberto Comand, Mirano (IT)

(73) Assignee: O.ME.R. S.p.A., Mirano (IT)

( * ) Notice: Subject to any disclaimer, the term of this patent is extended or adjusted under 35 U.S.C. 154(b) by 0 days.

(21) Appl. No.: 13/395,117

(22) PCT Filed: Sep. 8, 2010

(86) PCT No.: PCT/EP2010/063182
§ 371 (c)(1),
(2), (4) Date: Mar. 13, 2012

(87) PCT Pub. No.: WO2011/032872
PCT Pub. Date: Mar. 24, 2011

(65) Prior Publication Data

US 2012/0168701 A1 Jul. 5, 2012

(30) Foreign Application Priority Data

Sep. 17, 2009 (IT) ..... VE2009A0051

(51) Int. Cl.
*B66F 3/00* (2006.01)

(52) U.S. Cl. ..... 254/122; 254/89 H; 254/124; 254/126; 254/134

(58) Field of Classification Search ..... 254/122, 254/124, 126, 134, 89 H, 93 R, 93 L
See application file for complete search history.

(56) References Cited

U.S. PATENT DOCUMENTS

| | | | | |
|---|---|---|---|---|
| 2,471,901 | A | 5/1949 | Ross | |
| 3,246,876 | A | 4/1966 | Larson | |
| 3,891,108 | A * | 6/1975 | Traficant | 254/45 |
| 4,130,178 | A | 12/1978 | Smith, Jr. | |
| 4,815,712 | A * | 3/1989 | Kawada | 254/89 H |
| 5,322,143 | A * | 6/1994 | Curran | 187/211 |
| 5,636,711 | A | 6/1997 | Nussbaum | |
| 5,695,173 | A * | 12/1997 | Ochoa et al. | 254/122 |
| 6,286,629 | B1 * | 9/2001 | Saunders | 187/394 |
| 8,052,122 | B2 * | 11/2011 | Rossato et al. | 254/124 |
| 2001/0025952 | A1 * | 10/2001 | Wanner | 254/124 |
| 2010/0270523 | A1 * | 10/2010 | Schmitt et al. | 254/93 R |
| 2012/0168701 | A1 * | 7/2012 | Rossato et al. | 254/89 H |

FOREIGN PATENT DOCUMENTS

| | | |
|---|---|---|
| DE | 9414456 | 10/1994 |
| DE | 19744519 | 12/1998 |
| DE | 29916254 | 3/2000 |
| FR | 453168 | 6/1913 |
| FR | 2385638 | 10/1978 |
| FR | 2503119 | 10/1982 |
| GB | 2084543 | 4/1982 |

* cited by examiner

*Primary Examiner* — Lee D Wilson
(74) *Attorney, Agent, or Firm* — Themis Law

(57) ABSTRACT

A motor vehicle lift includes two parallel runways, each provided with at least two elevating devices each having first and second uprights hinged to each other, to the floor (runway) and to the runway (floor) respectively; first and second arms hinged together, the second arm being further hinged to the second upright along a hinging axis equidistant from the axis on which the second upright is hinged to the runway (floor) and from the end of the second arm, which is slidable along a guide provided in the runway (floor), the first arm being also hinged to the first upright; and an actuator device securable selectively to two elements of the quadrilateral formed from the first/second uprights and the first/second arms, at least one of the parts of the quadrilateral being provided with elastic means to vary the dimension between the two hinged ends.

11 Claims, 4 Drawing Sheets

VEHICLE LIFT

FIELD OF THE INVENTION

The present invention relates to a lift.

SUMMARY OF THE INVENTION

An object of the invention is to provide a lift able to compensate deformations and misalignments, and hence prevent internal overloads on the various structural components.

Another object of the invention is to provide a lift able to assume a deformed geometry and/or to absorb unbalanced load s, while always remaining in equilibrium and without generating structural overloads.

These objects are attained according to the invention by a lift for motor vehicles as described hereinafter

BRIEF DESCRIPTION OF THE DRAWINGS

The present invention is described in detail hereinafter with reference to the accompanying drawings, in which.

DETAILED DESCRIPTION OF A PREFERRED EMBODIMENT

Figure 1:
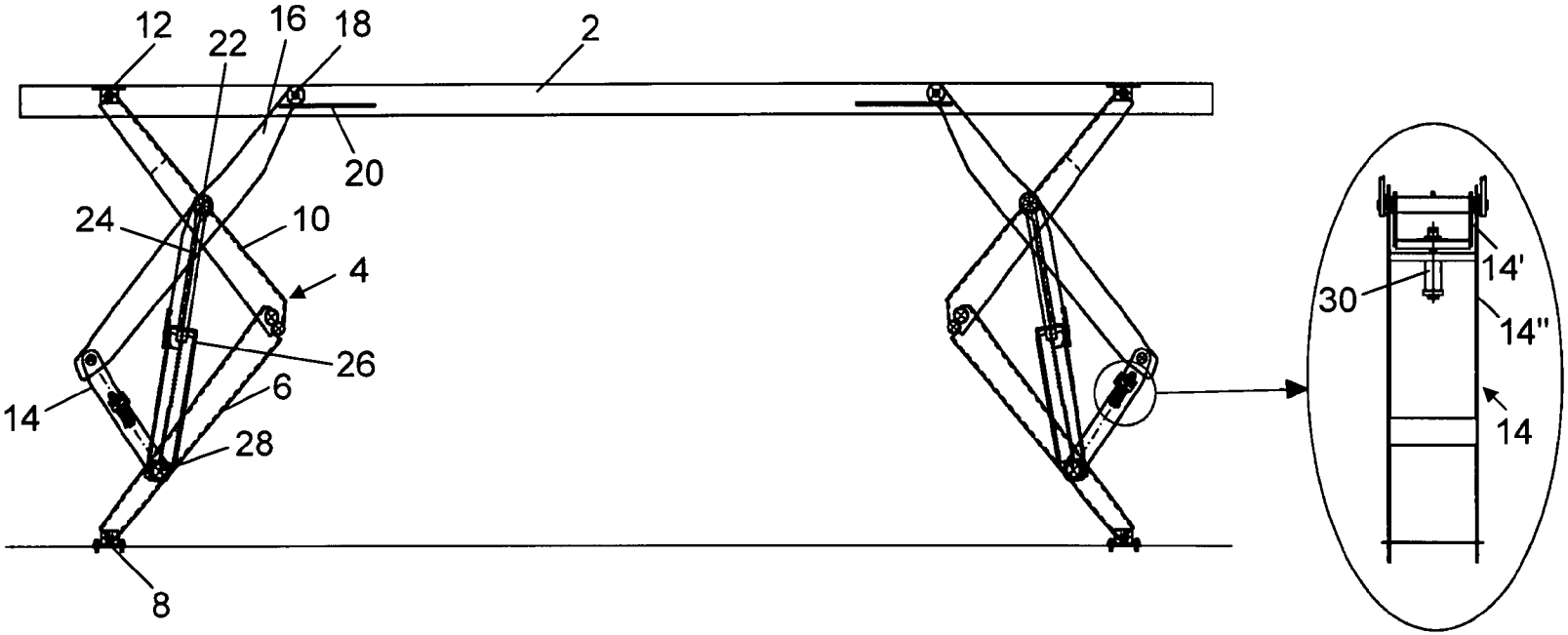
FIG. 1 is a side view of a lift according to the invention in its raised condition.
Figure 2:
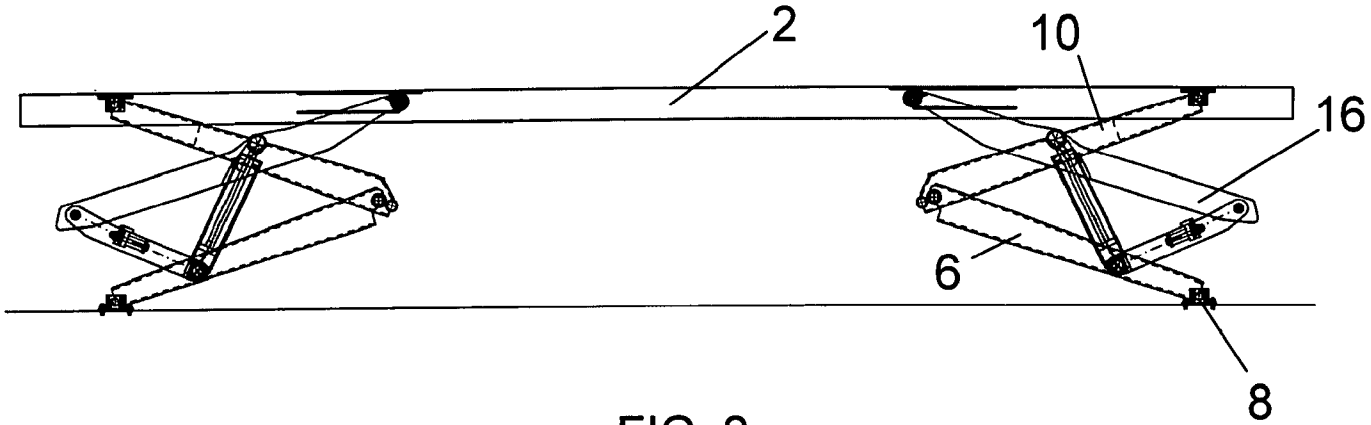
FIG. 2 shows it in an intermediate stage.
Figure 3:
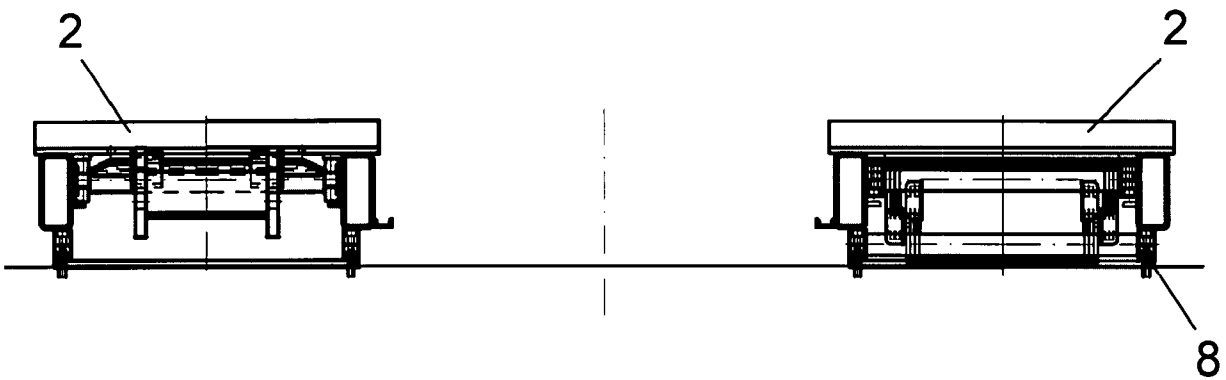
FIG. 3 shows it in front view in its lowered condition.
Figure 4:
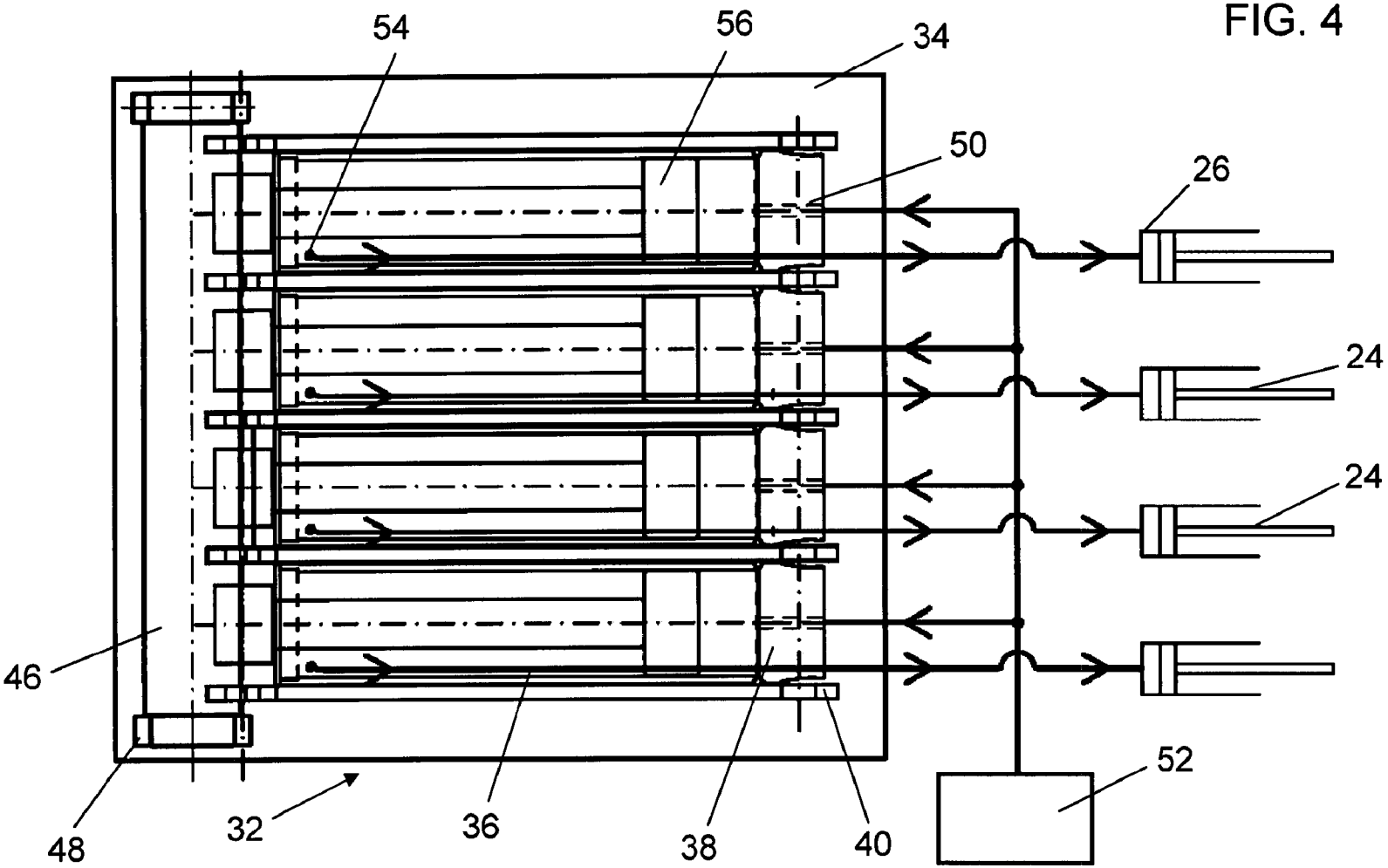
FIG. 4 shows in schematic plan view a flow synchronizer for feeding the hydraulic cylinder-piston units.
Figure 5:
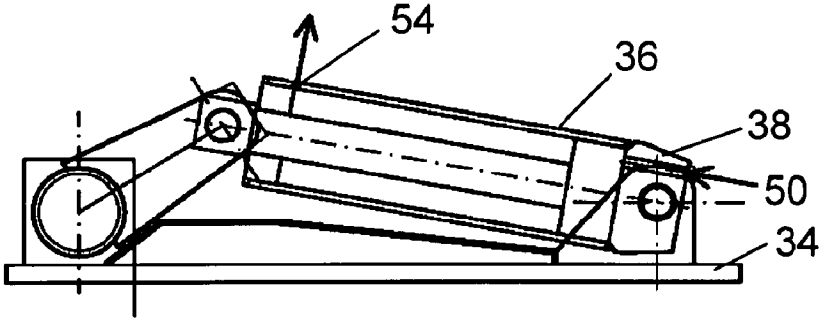
FIGS. 5-7 show the movement steps of a cylinder forming an element of the flow synchronizer.
Figure 6:
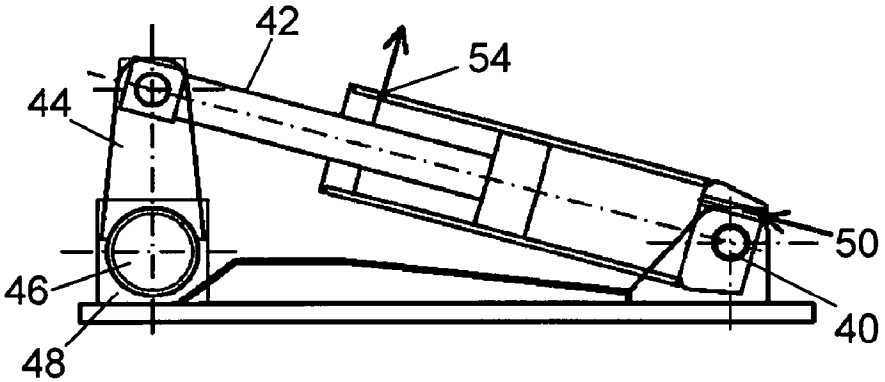
Figure 7:
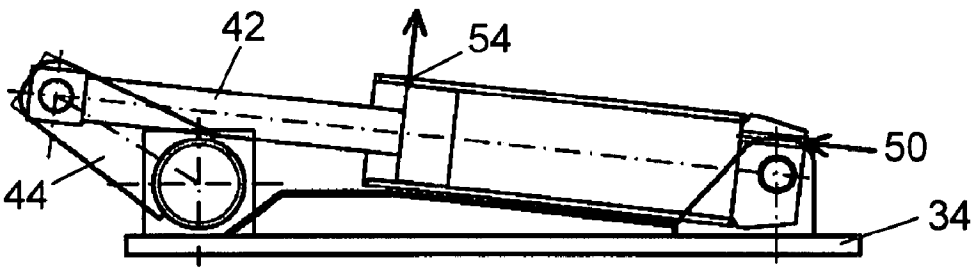

As can be seen from the figures, the lift of the invention comprises substantially a pair of runways 2 raisable from the floor by elevators indicated overall by 4, which in the illustrated embodiment are two in number.

Each elevator comprises a first upright 6, hinged to a hinging bracket 8 fixed to the workshop floor or to a base longitudinal member, the upright being hinged at its other end to a second upright 10 of the same length, which at its other end is hinged to a lug 12 provided on the runway 2.

Also hinged to the first upright 6 there is a first arm 14 hinged at its other end to a second arm 16, the other end of which is provided with rollers or slide blocks 18 slidable along guides 20 provided on the longitudinal members of the runways.

The second arm 16 is also hinged to the second upright 10 on a pin 22, such that the distance of the pin 22 from the lug 12 corresponds to the distance of the pin 22 from the roller 18.

Also hinged on the pin 22 is the end of a piston rod 24 of a cylinder-piston unit, of which the cylinder 26 is hinged on the pin 28 on which the first arm 14 is hinged to the first upright 6.

The first arm 14 is formed in two separate portions 14', 14" connected together by a compensation hydraulic cylinder-piston unit 30.

The cylinders 36 are fed via a flow synchronizer 32, which simultaneously ensures an equal movement of the piston rods 24 within the cylinders 26 and hence guarantees synchronism of movement of the runways 2 during lifting and descent.

The flow synchronizer 32 comprises substantially a base 34 on which four double acting cylinders 36 are mounted with their longitudinal axes parallel.

Each cylinder 36 is hinged at its bottom 38 to lugs 40 rigid with the base, the piston rod 42 of each cylinder having its free end hinged to a crank 44 rigid with a torsion bar 46 perpendicular to the longitudinal axis of the cylinders and hinged at its ends to brackets 48.

Each cylinder is provided with an entry conduit 50 for hydraulic fluid originating from a control center 52, and with an exit conduit 54 for feeding the hydraulic cylinder-piston units for raising the lift runways 2.

The lift of the invention operates in the following manner: when in its lowered condition, the hydraulic cylinder-piston units are in their condition of minimum elongation. Under these conditions, the vehicle (not shown in the drawings) can be driven onto the runways.

Operating fluid is then fed into the hydraulic cylinder-piston units via the synchronizer 32.

The hydraulic fluid fed by the control center 52 is distributed into the cylinders 36 from the bottom 38, to hence move the piston heads 56 and cause oil to leave through the conduits 54, to feed the hydraulic cylinder-piston units, with consequent rotation of the torsion bar 46 via the crank 44.

As the cylinder-piston units gradually lengthen, and by virtue of the particular choice of hinge points:

the uprights 6, 10, which when the lift is in its lowered configuration are practically coplanar, are rotated relative to each other, such that the angle formed between them increases, the arms 14, 16 are also rotated relative to each other, such that the angle formed between them increases, and while the arm 14 rotates about the pin on which it is hinged to the arm 16, its other end slides with the roller 18 along the guide 20 in the sense of approaching the hinge 12.

The result is an upward translation of the runways 2 from the floor, while remaining parallel to this latter.

When the lift is subjected to an unbalanced load, the hydraulic cylinder-piston unit enables the two portions 14', 14" of the arm 14 to assume a deformed geometry and consequently absorb this unbalance.

It is apparent that if there is a non-uniform load distribution on the lift runways, the effect of the different pressure on the hydraulic cylinder-piston unit concerned will be to move the rod 42 of the corresponding piston, but as all the piston rods are connected together by the torsion bar 46, this movement will result in the synchronized movement of all the pistons of the bank.

In a different embodiment, the elastic element can be provided at the end of the second arm 24 supporting the roller 18.

In a further embodiment, the elastic element can consist of a slotted hole in which the end of the first upright 6 engages.

In a variant, not shown on the drawings, the uprights are hinged to longitudinal members resting on the floor.

In other variants, the elastic element, which can be of adjustable type, can consist of a wheel positioned at the end of the first upright or be inserted into the hinge pins of the first and/or second arm.

The invention claimed is:

1. A motor vehicle lift comprising:

two parallel runways for supporting vehicle wheels, each runway being provided with at least two devices for elevating the vehicle wheels from the floor, wherein each device comprises:

a pair of equal-length first (6) and second (10) uprights having an end hinged to each other, and another end hinged to a floor and to the runway respectively, in positions corresponding with two superposed vertical axes, a pair of first (14) and second (16) arms hinged together at one end, the first arm (14) having a length shorter than that one a length of the second arm (16), which is hinged to the second upright (10) along a hinge pin (22) equidistant from an axis (12) on which the second upright (10) is hinged to the runway (2) and from an end (18) of the second arm (16) which is slidable along a guide (20) provided in the runway (2), the first arm (14) being hinged at the other end to the first upright (6) in a position such that a distance of the hinge pin (22) of the second arm (16)/second upright (10) from the hinging axis of the first upright (6)/second upright (10) corresponds to a distance of a hinging axis of the first arm (14)/second arm (16) from a hinge pin (28) of the first arm (14)/first upright (6), an actuator device (24, 26) having ends hinged on said hinge pin (22) and on said hinge pin (28) respectively, and at least one of the first/second uprights or first/second arm being provided with an elastic element (30) enabling it to vary the dimension between its hinged ends.

2. The lift as claimed in claim 1, wherein the first arm (14) is formed in two separate portions (14', 14") connected together by a hydraulic cylinder (30).

3. The lift as claimed in claim 1, wherein the elastic element is provided at that end of the second arm (16) slidable along the guide (20).

4. The lift as claimed in claim 1, wherein the elastic element consists of a slotted hole in which a lower end of the first upright (6) is hinged.

5. The lift as claimed in claim 1, wherein the elastic element consists of a wheel positioned at the end of the first upright.

6. The lift as claimed in claim 1, wherein the elastic element is inserted into the hinge pins of the first and/or of the second arm.

7. The lift as claimed in claim 1, the elastic element is of adjustable type.

8. The lift as claimed in claim 1, wherein the actuator device comprises hydraulic cylinder-piston units.

9. The lift as claimed in claim 1, wherein a flow synchronizer (32) is associated with the actuator device.

10. The lift as claimed in claim 9, wherein the flow synchronizer (32) comprises a control center (54) which feeds a hydraulic fluid to equal double acting cylinders (36) with parallel longitudinal axes, hinged at their bottoms to a fixed structure (34), rods (42) of cylinder pistons being hinged at their free end to a crank (44) rigid at its other end with a torsion bar (46) disposed perpendicular to an axis of the cylinders (36) and hinged to the fixed structure, hydraulic fluid outlets (54) of said cylinders (36) leading to hydraulic members for raising the lift.

11. The lift as claimed in claim 10, wherein bottoms (38) of the cylinders (36) are hinged to lugs (40) rigid with the fixed structure (34), with which hinging brackets (48) for a tension bar are also rigid.

* * * * *